US010538004B2

(12) United States Patent
Wang et al.

(10) Patent No.: US 10,538,004 B2
(45) Date of Patent: Jan. 21, 2020

(54) ATTACHMENT OF ELECTRIC HAIR TRIMMER

(71) Applicant: Panasonic Intellectual Property Management Co., Ltd., Osaka (JP)

(72) Inventors: Wei Wang, Shiga (JP); Takashi Yamaguchi, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/870,455

(22) Filed: Jan. 12, 2018

(65) Prior Publication Data

US 2018/0207818 A1 Jul. 26, 2018

(30) Foreign Application Priority Data

Jan. 26, 2017 (JP) ..... 2017-012115

(51) Int. Cl.
*B26B 19/38* (2006.01)
*B26B 19/04* (2006.01)
*B26B 19/20* (2006.01)

(52) U.S. Cl.
CPC ..... *B26B 19/3813* (2013.01); *B26B 19/04* (2013.01); *B26B 19/20* (2013.01)

(58) Field of Classification Search
CPC ..... B26B 19/3813; B26B 19/20; B26B 19/04
USPC ..... 30/233.5
See application file for complete search history.

(56) References Cited

U.S. PATENT DOCUMENTS 3,648,370 A 3/1972 Cercone
4,776,095 A * 10/1988 Tsujimoto ..... B26B 19/20 30/201
4,845,852 A * 7/1989 Sukow ..... B26B 19/20 30/201
4,949,460 A * 8/1990 Sterk ..... B26B 19/20 30/200
5,699,616 A 12/1997 Ogawa
(Continued)

FOREIGN PATENT DOCUMENTS

CN 203031633 U 7/2013
DE 2713785 A1 10/1978
(Continued)

OTHER PUBLICATIONS

The Extended European Search Report dated Jun. 12, 2018 for the related European Patent Application No. 18151798.8.
(Continued)

*Primary Examiner* — Hwei-Siu C Payer
(74) *Attorney, Agent, or Firm* — McDermott Will & Emery LLP

(57) ABSTRACT

An attachment of an electric hair trimmer according to the present disclosure is mountable on an electric hair trimmer, and a cutting length which is a length of hair introduced between a fixed blade and a movable blade is adjustable. The attachment of the electric hair trimmer according to the present disclosure includes: a mounting portion which is mounted on a head portion so as to cover a head portion; a slide portion which is mounted on the mounting portion in a slidable manner with respect to the mounting portion such that the cutting length is changed; and a comb which is provided on the slide portion so as to guide hair between the fixed blade and the movable blade.

20 Claims, 11 Drawing Sheets

(56) References Cited

U.S. PATENT DOCUMENTS

| | | | | |
|---|---|---|---|---|
| 6,276,060 | B1 * | 8/2001 | Faulstich | B26B 19/20 30/34.1 |
| 6,618,948 | B2 * | 9/2003 | Lin | B26B 19/20 30/233.5 |
| 8,844,142 | B2 * | 9/2014 | Kammer | B26B 19/3846 30/201 |
| 2005/0138817 | A1 * | 6/2005 | Yamaguchi | B26B 19/06 30/233 |
| 2006/0042095 | A1 * | 3/2006 | Yamaguchi | B26B 19/06 30/201 |
| 2012/0233865 | A1 | 9/2012 | Kammer | |
| 2013/0219724 | A1 * | 8/2013 | Werner | B26B 19/20 30/201 |
| 2013/0263457 | A1 * | 10/2013 | Sobagaki | B26B 19/20 30/201 |
| 2018/0207817 | A1 * | 7/2018 | Wang | B26B 19/06 |
| 2018/0207818 | A1 * | 7/2018 | Wang | B26B 19/3813 |

FOREIGN PATENT DOCUMENTS

| | | | |
|---|---|---|---|
| JP | 1-214388 | A | 8/1989 |
| JP | H08-000848 | A | 1/1996 |
| JP | 8-187374 | A | 7/1996 |
| JP | 2001-246183 | A | 9/2001 |
| WO | 2008/028332 | A1 | 3/2008 |
| WO | 2015/197272 | A1 | 12/2015 |

OTHER PUBLICATIONS

Panasonic Corporation "Ferrier ES-WF60 for face", [online], [searched on Dec. 22 2017], Internet <URL: http://panasonic.jp/face/p-db/ES-WF60/ >, with concise explanation of web page in English.

* cited by examiner

ATTACHMENT OF ELECTRIC HAIR TRIMMER

RELATED APPLICATIONS

This application claims the benefit of priority to Japanese Application No. 2017-012115, filed on Jan. 26, 2017, the disclosure of which is incorporated by reference herein in its entirety.

BACKGROUND

1. Technical Field

The present disclosure relates to an attachment of an electric hair trimmer.

2. Description of the Related Art

As one example of an attachment of an electric hair trimmer, there has been known an attachment which is mountable on a head portion of an electric hair trimmer mainly used for cutting eyebrows. When the attachment is mounted on the head portion, a cutting length is determined based on a position of the attachment relative to the head portion. One example of an attachment of a conventional electric hair trimmer is disclosed in Non-Patent Literature of PANASONIC CORPORATION "Ferrier ES-WF60 for face", [online], [searched on Dec. 22, 2017], Internet <URL: http://panasonic.jp/face/p-db/ES-WF60/>. In this conventional electric hair trimmer, a cutting length can be adjusted in three steps (2·4·6 mm) based on a position of an attachment relative to a head portion.

SUMMARY

With respect to the above-mentioned attachment, it is necessary to remove a mounting portion from the head portion each time a cutting length is to be changed. Accordingly, there is still a room for improvement with respect to operability of the electric hair trimmer.

According to one aspect of an attachment of an electric hair trimmer of the present disclosure, there is provided an attachment of an electric hair trimmer which is mountable on an electric hair trimmer configured such that an angle formed by a moving direction of a movable blade with respect to a faxed blade provided on a head portion and a longitudinal direction of a grip portion which supports the head portion is an acute angle or the moving direction and the longitudinal direction are parallel to each other, and is configured to adjust a cutting length which is a length of hair introduced between the fixed blade and the movable blade. The attachment of the electric hair trimmer includes: a mounting portion which is mounted on the head portion so as to cover the head portion; a slide portion which is mounted on the mounting portion in a slidable manner with respect to the mounting portion so as to change the cutting length; and a comb which is provided on the slide portion so as to guide hair between the fixed blade and the movable blade.

According to the attachment of an electric hair trimmer of the present disclosure, usability in operation of an electric hair trimmer by a user is enhanced.

Figure 1:
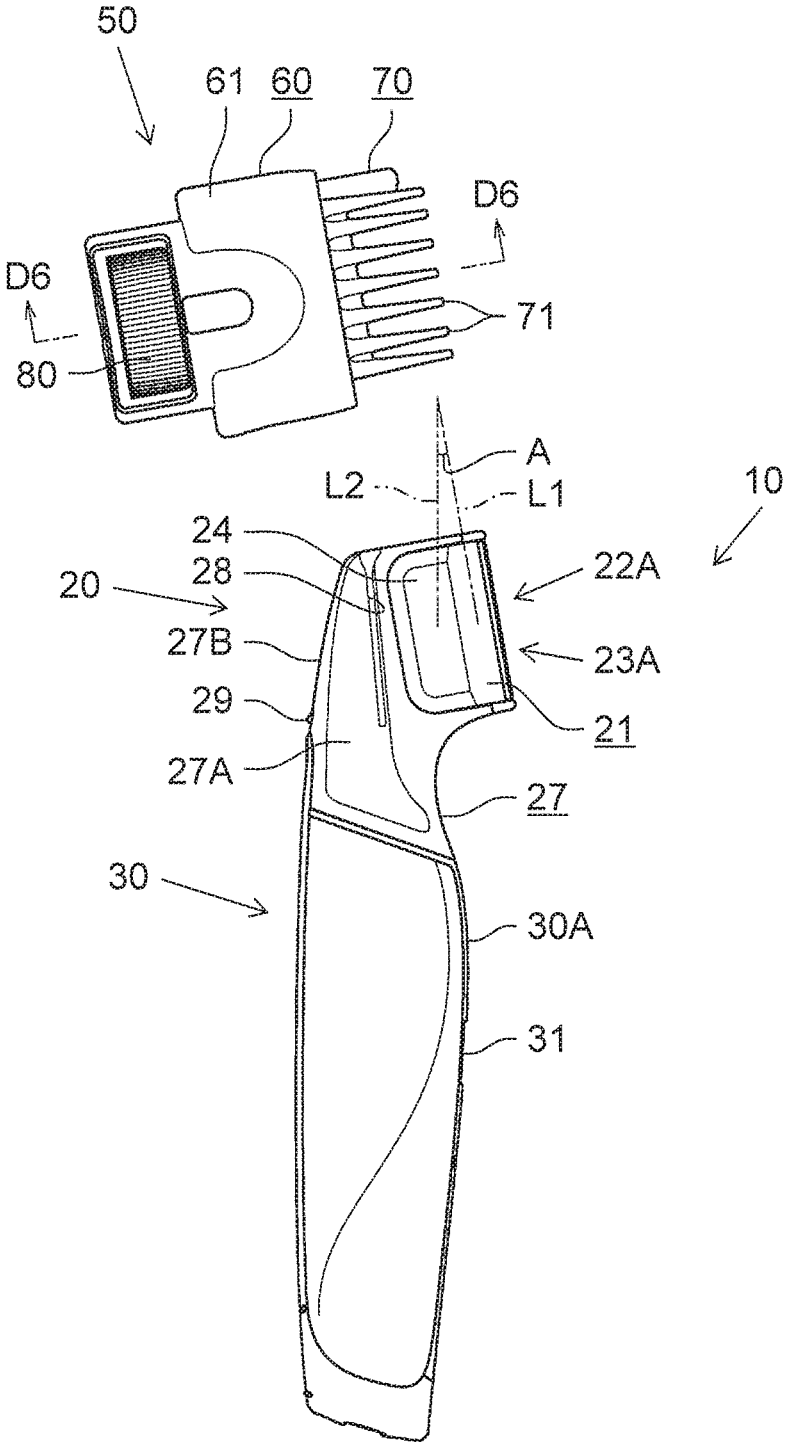
FIG. 1 is a side view showing an electric hair trimmer and an attachment of an exemplary embodiment.

DETAILED DESCRIPTION (One Example of a Mode which the Attachment of the Electric Hair Trimmer can Take)

An attachment of an electric hair trimmer of the present disclosure is an attachment of an electric hair trimmer which is mountable on an electric hair trimmer configured such that an angle formed by a moving direction of a movable blade with respect to a fixed blade provided on a head portion and a longitudinal direction of a grip portion which supports the head portion is an acute angle or the moving direction and the longitudinal direction are parallel to each other, and is configured to adjust a cutting length which is a length of hair introduced between the fixed blade and the movable blade. The attachment of the electric hair trimmer includes: a mounting portion which is mounted on the head portion so as to cover the head portion; a slide portion which is mounted on the mounting portion in a slidable manner with respect to the mounting portion so as to change the cutting length; and a comb which is provided on the slide portion so as to guide hair between the fixed blade and the movable blade. The slide portion can be slid relative to the mounting portion in a state where the attachment of the electric hair trimmer is mounted on the head portion and hence, a user can easily adjust a cutting length. Accordingly, usability in operation of the electric hair trimmer by a user is enhanced.

According to one example of the attachment of the electric hair trimmer, the attachment further includes an operation part which is operated for moving the slide portion relative to the mounting portion. Accordingly, usability in operation of the electric hair trimmer by a user is enhanced.

According to one example of the attachment of the electric hair trimmer, the operation part is provided on a side opposite to the comb with respect to the mounting portion. With such a configuration, when hair to be cut on a hair-cutting desired portion is cut using the electric hair trimmer on which the attachment is mounted, the operation part is hardly brought into contact with the hair-cutting desired portion.

According to one example of the attachment of the electric hair trimmer, the operation part includes a ring rotatable relative to the mounting portion. The slide portion is slidable relative to the mounting portion by rotating the ring and hence, a user can easily adjust a cutting length.

According to one example of the attachment of the electric hair trimmer, the attachment further includes a movement converting part which converts a rotational movement of the ring into a translational movement of the slide portion. Accordingly, the arrangement of the ring can be set without depending on the direction of the translational movement of the slide portion.

According to one example of the attachment of the electric hair trimmer, the movement converting part includes: a helical groove; and a projection which is inserted in the helical groove such that the projection is movable in the helical groove, and one of the helical groove and the projection is formed on an inner peripheral surface of the ring, and another of the helical groove and the projection is formed on an outer surface of the slide portion. A moving amount of the slide portion can be made small compared to a rotation amount of the ring and hence, a user can easily adjust a cutting length.

According to one example of the attachment of the electric hair trimmer, the attachment further includes a support portion which is capable of supporting the slide portion, and the support portion includes: the mounting portion; and an opening which allows the insertion of the head portion into the mounting portion due to the movement thereof relative to the fixed blade and the movable blade along a longitudinal direction of the fixed blade and the movable blade. Accordingly, the attachment can be easily mounted on the head portion.

According to one example of the attachment of the electric hair trimmer, the comb includes a hair lifting portion formed on a distal end portion of the comb such that the comb is capable of lifting hair. The hair lifting portion includes an inclined surface inclined in a direction opposite to the fixed blade and the movable blade as the hair lifting portion extends from a proximal end side of the comb to a distal end side of the comb. Hair is lifted by the inclined surface of the hair lifting portion and hence, hair hardly remains after shaving.

According to one example of the attachment of the electric hair trimmer, the comb includes a plurality of combs. The plurality of combs include: a first comb which is arranged in a longitudinal direction of the fixed blade and the movable blade, and is disposed on one side portion with respect to the fixed blade and the movable blade; and a second comb which is arranged in the longitudinal direction of the fixed blade and the movable blade, and is disposed on another side portion with respect to the fixed blade and the movable blade, and the fixed blade and the movable blade are capable of being disposed between distal end portions of a plurality of first teeth included in the first comb and distal end portions of a plurality of second teeth included in the second comb. Hair is introduced also toward the fixed blade and the movable blade through between the distal end portions of a plurality of first teeth included in the first comb and distal end portions of a plurality of second teeth included in the second comb. Accordingly, hair can be easily cut by the fixed blade and the movable blade.

According to one example of the attachment of the electric hair trimmer, the comb includes a plurality of combs. The plurality of combs include: a first comb which is arranged in a longitudinal direction of the fixed blade and the movable blade, and is disposed on one side portion with respect to the fixed blade and the movable blade; a second comb which is arranged in the longitudinal direction of the fixed blade and the movable blade, and is disposed on another side portion with respect to the fixed blade and the movable blade; and a connecting portion which connects distal end portions of a plurality of first teeth included in the first comb and distal end portions of a plurality of second teeth included in the second comb so as to cover the fixed blade and the movable blade. In cutting hair on a haircutting desired portion by bringing the attachment into contact with the hair-cutting desired portion, contact between the hair-cutting desired portion and the fixed blade and the movable blade is obstructed by the connecting portion. Accordingly, the fixed blade and the movable blade are hardly brought into contact with the hair-cutting desired portion.

According to one example of the attachment of the electric hair trimmer, the mounting portion is mountable on the head portion of the electric hair trimmer having a size suitable for cutting beard and head hair. Accordingly, beard and head hair can be easily cut by using the electric hair trimmer on which the attachment is mounted.

Exemplary Embodiment

FIG. 1 shows a configuration of electric hair trimmer 10 and attachment 50. Electric hair trimmer 10 has a size suitable for cutting beard and head hair, for example. One example of electric hair trimmer 10 includes a trimmer. Attachment 50 has a function of adjusting a length of hair cut by electric hair trimmer 10 (hereinafter, referred to as "cutting length"). Attachment 50 is mountable on electric hair trimmer 10. FIG. 1 shows a state where attachment 50 is removed from electric hair trimmer 10.

Electric hair trimmer 10 includes head portion 20 and grip portion 30. Head portion 20 includes blade unit 21 and support unit 27. Blade unit 21 has a function of cutting hair. Blade unit 21 is detachably provided on support unit 27. Blade unit 21 includes fixed blade 22A and movable blade 23A. Support unit 27 has a function of supporting blade unit 21. As one example, support unit 27 supports blade unit 21 such that a cutting edge of fixed blade 22A and a cutting edge of movable blade 23A are directed in a direction intersecting with a longitudinal direction of grip portion 30. Grip portion 30 is configured to be gripped by a user with one hand. Grip portion 30 supports head portion 20. As one example, grip portion 30 is integrally formed with support unit 27.

Electric hair trimmer 10 is configured such that an angle formed by a moving direction of movable blade 23A with respect to fixed blade 22A and the longitudinal direction of grip portion 30 is an acute angle, for example. The moving direction of movable blade 23A with respect to fixed blade 22A extends along the longitudinal direction of fixed blade 22A and movable blade 23A. As shown in FIG. 1, more specifically, electric hair trimmer 10 is configured such that angle A formed by first imaginary line L1 along the moving direction of movable blade 23A and second imaginary line L2 along the longitudinal direction of grip portion 30 is an acute angle. Angle A is determined based on the operability at the time of cutting hair using electric hair trimmer 10. As one example, angle A is preferably set to 45° or below. As one example, angle A is 10°. Electric hair trimmer 10 may be configured such that the moving direction of movable blade 23A with respect to fixed blade 22A and the longitudinal direction of grip portion 30 are parallel to each other.

Figure 2:
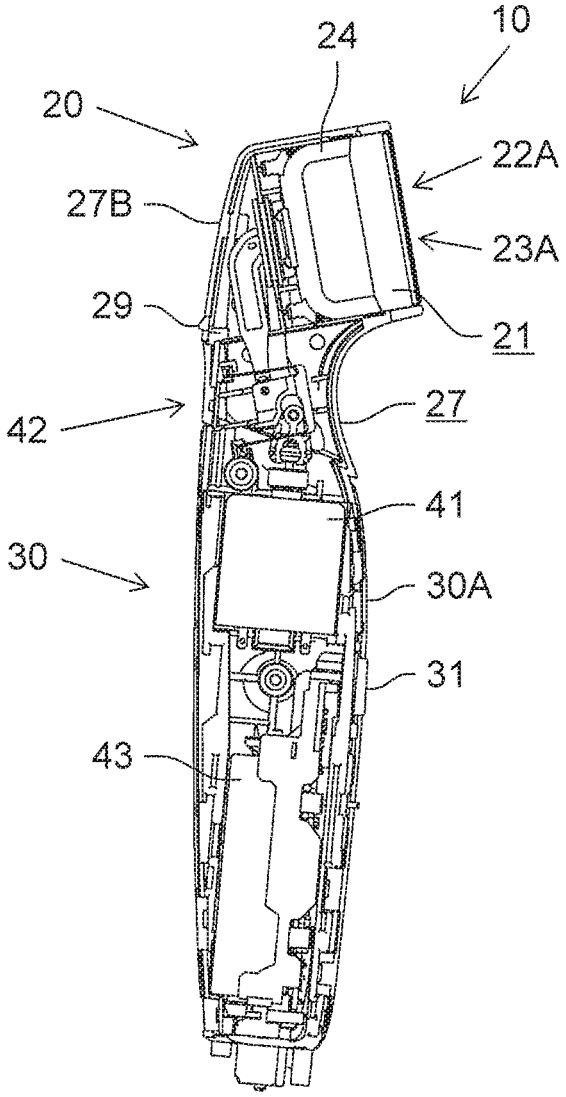
FIG. 2 is a side view showing a structure in an inside of the electric hair trimmer shown in FIG. 1.

As shown in FIG. 2, respective elements which constitute electric hair trimmer 10 are accommodated inside grip portion 30 and support unit 27. Electric hair trimmer 10 further includes electric motor 41, movement converting part 42, and power source part 43. Electric motor 41 is accommodated inside grip portion 30, for example, and is electrically connected with power source part 43. Movement converting part 42 is accommodated inside support unit 27 of head portion 20, for example, and is joined to an output shaft of electric motor 41.

Movement converting part 42 has a function of converting a rotational movement of the output shaft of electric motor 41 into a translational movement. Power source part 43 is accommodated inside grip portion 30, for example, and is capable of supplying power to electric motor 41. Power source part 43 is a primary battery or a secondary battery, for example.

Figure 3:
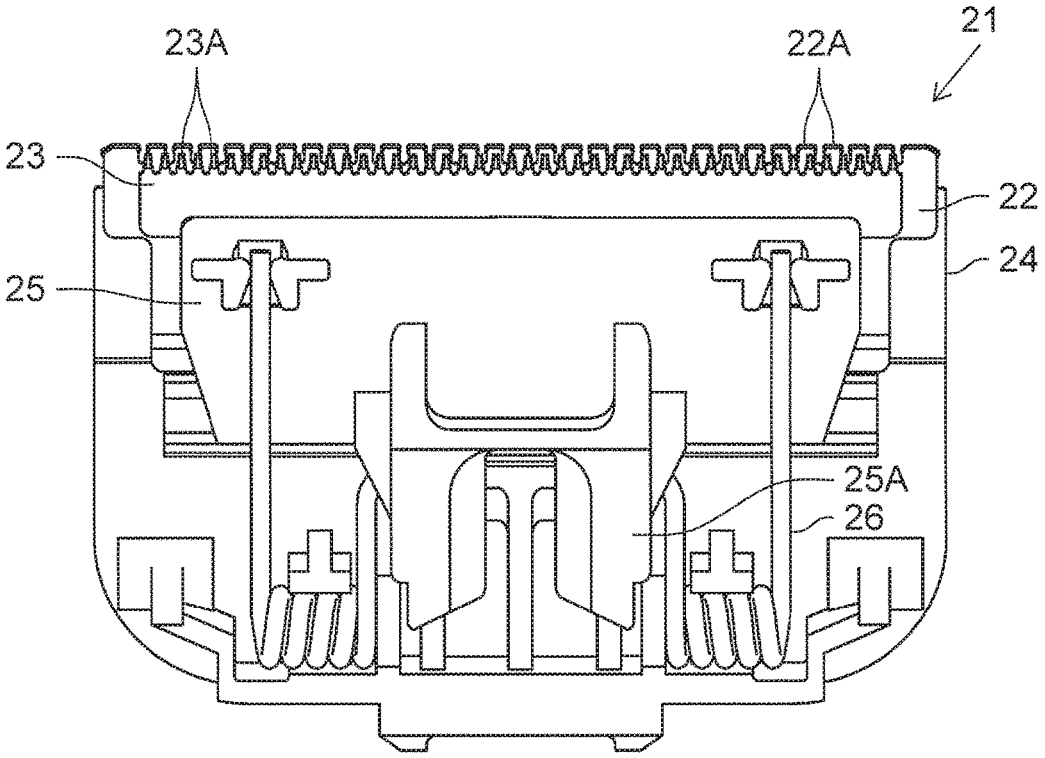
FIG. 3 is a front view showing an inner surface of a blade unit shown in FIG. 1.

As shown in FIG. 3, blade unit 21 further includes fixed plate 22, movable plate 23, frame 24, holding plate 25, and spring 26. Fixed plate 22 includes a plurality of fixed blades 22A. Movable plate 23 includes a plurality of movable blades 23A. Fixed plate 22 and movable plate 23 opposedly face each other. Frame 24 supports fixed plate 22 from a side opposite to a side where movable plate 23 is disposed with respect to fixed plate 22, and holds fixed plate 22 so as to prevent a positional displacement of fixed plate 22. Holding plate 25 supports movable plate 23 from a side opposite to a side where fixed plate 22 is disposed with respect to movable plate 23, and holds movable plate 23 so as to prevent a positional displacement of movable plate 23. Spring 26 is mounted on frame 24, for example, and by pushing movable plate 23 to fixed plate 22 by spring 26, fixed blade 22A and movable blade 23A are brought into contact with each other. One example of spring 26 includes a double torsion spring.

Holding plate 25 includes connection portion 25A. Connection portion 25A is connected with movement converting part 42 (see FIG. 2) in a state where blade unit 21 is mounted on support unit 27 (see FIG. 2). By driving electric motor 41 (see FIG. 2), only a force in a width direction of blade unit 21 is transmitted to connection portion 25A from movement converting part 42, and movable plate 23 moves in a reciprocating manner in the width direction of blade unit 21 by way of holding plate 25. Accordingly, the plurality of movable blades 23A move in a reciprocating manner with respect to the plurality of fixed blades 22A.

As shown in FIG. 1, electric hair trimmer 10 further includes power source switch 31. Power source switch 31 has a function of switching on and off the power source of electric hair trimmer 10. Power source switch 31 is provided on front surface 30A of grip portion 30, for example. When power source switch 31 is tuned on, electric motor 41 (see FIG. 2) is driven so that movable blades 23A move in a reciprocating manner with respect to fixed blades 22A. Accordingly, hair introduced between fixed blades 22A and movable blades 23A is cut.

Figure 4:
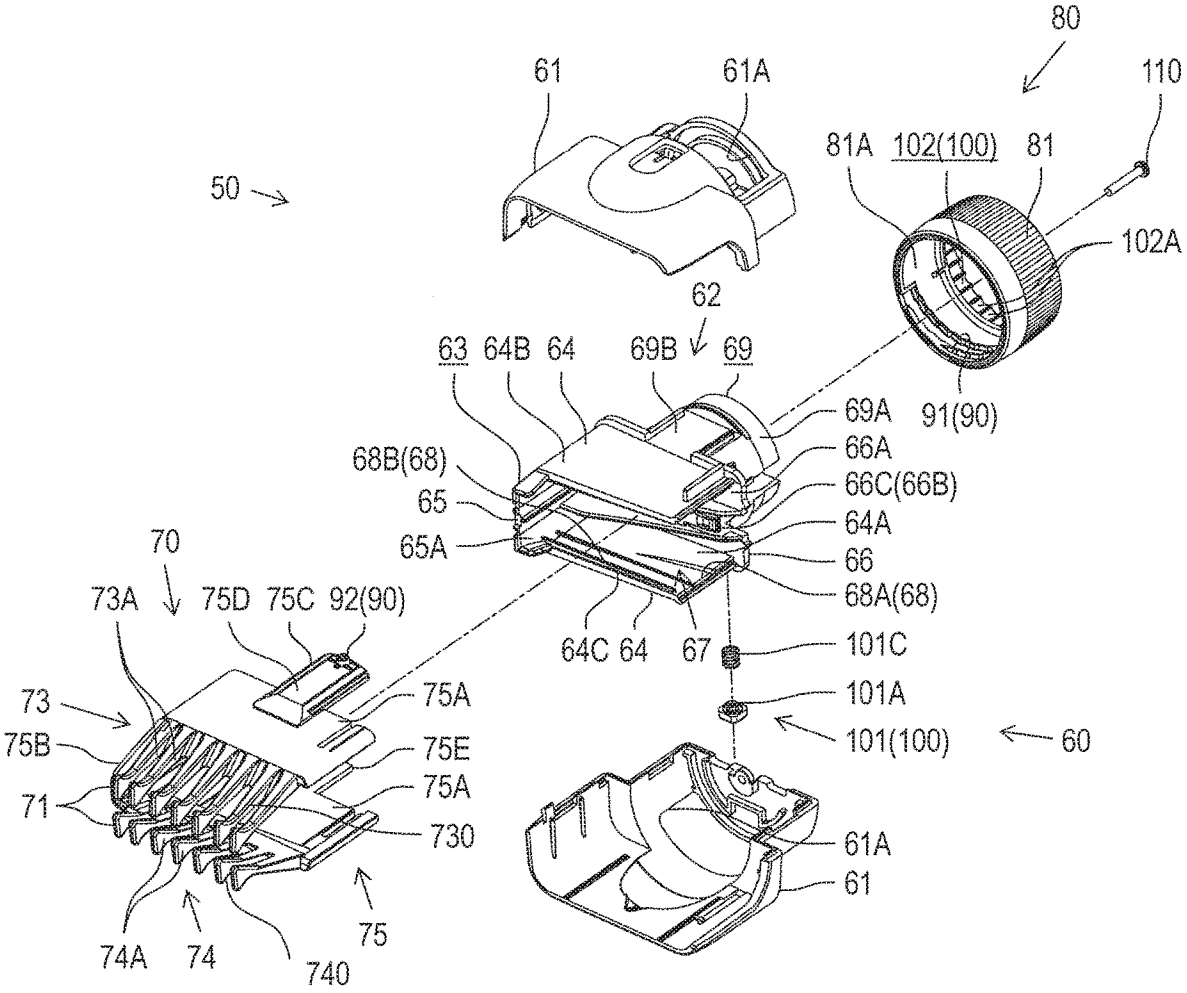
FIG. 4 is an exploded perspective view of the attachment shown in FIG. 1.

With reference to FIG. 4, the configuration of attachment 50 is described.

Attachment 50 includes holding member 60, slide portion 70, and operation part 80. Holding member 60 has a function of holding slide portion 70 and operation part 80. Attachment 50 is constituted by holding slide portion 70 and operation part 80 using holding member 60.

Holding member 60 includes a pair of cases 61 and support portion 62. The pair of cases 61 constitutes an outer shell of attachment 50. The pair of cases 61 is detachably mounted on support portion 62, and is mounted on support portion 62 so as to cover whole support portion 62. Support portion 62 has a function of supporting slide portion 70. Support portion 62 includes first support portion 63 and second support portion 69. As one example, first support portion 63 is integrally formed with second support portion 69.

As one example, first support portion 63 has an approximately rectangular parallelepiped shape, and, for example, a part of the first support portion 63 has an opening on a surface thereof. First support portion 63 includes a pair of first side walls 64, second side wall 65, and bottom wall 66. The pair of first side walls 64 constitutes surfaces extending along a longitudinal direction of first support portion 63. Second side wall 65 constitutes a surface extending in the longitudinal direction of first support portion 63, and connects one first side wall 64 and the other first side wall 64 to each other. Bottom wall 66 constitutes a surface extending in the longitudinal direction of first support portion 63, and connects one first side wall 64 and the other first side wall 64 to each other.

First support portion 63 further includes mounting portion 67 and opening 68. Mounting portion 67 is mountable on head portion 20 so as to cover head portion 20 (see FIG. 1) of electric hair trimmer 10. Mounting portion 67 is provided on an inner surface of first support portion 63. As one example, mounting portion 67 is constituted of inner surfaces 64A of the pair of first side walls 64, inner surface 65A of second side wall 65, and inner surface 66A of bottom wall 66.

Opening 68 is formed such that head portion 20 can be inserted in mounting portion 67 by moving first support portion 63 relative to fixed blades 22A and movable blades 23A along a longitudinal direction of fixed blades 22A and movable blades 23A (see FIG. 1). The longitudinal direction of fixed blades 22A and movable blades 23A extends along a longitudinal direction of first support portion 63. By inserting head portion 20 in mounting portion 67 through opening 68, attachment 50 is mounted on head portion 20. Accordingly, the attachment 50 can be easily mounted on head portion 20. Opening 68 includes first opening 68A and second opening 68B. First opening 68A opposedly faces second side wall 65 at first support portion 63, for example. Second opening 68B opposedly faces bottom wall 66 at first support portion 63, for example. First opening 68A and second opening 68B are continuously formed with each other. Opening 68 is exposed in a state where the pair of cases 61 and slide portion 70 are mounted on support portion 62.

First support portion 63 further includes guide portion 64C and connecting portion 66B. Guide portion 64C has a function of guiding mounting of attachment 50 on head portion 20. For example, guide portion 64C is formed on inner surfaces 64A of the pair of first side walls 64 respectively. Guide portion 64C is insertable in groove 28 formed on head portion 20 (see FIG. 1). As one example, guide portion 64C constitutes a projection extending in the longitudinal direction of first support portion 63. Groove 28 of head portion 20 is formed on respective side surfaces 27A of support unit 27 so as to extend in the longitudinal direction of fixed blades 22A and movable blades 23A (see FIG. 1). By inserting guide portions 64C in grooves 28 formed on head portion 20, mounting of attachment 50 on head portion 20 is guided.

Connecting portion 66B has a function of joining attachment 50 and head portion 20 to each other. Connecting portion 66B is provided on inner surface 66A of bottom wall 66, for example. Connecting portion 66B includes recess 66C. Recess 66C is engageable with projection 29 formed on head portion 20 by fitting engagement (see FIG. 1). Projection 29 of head portion 20 is provided on back surface 27B of support unit 27, for example. Attachment 50 and head portion 20 are joined to each other in such a manner that guide portions 64C are inserted in grooves 28 of head portion 20 and recess 66C of connecting portion 66B is fitted on projection 29 of head portion 20.

Second support portion 69 has an approximately circular columnar shape, for example. Second support portion 69 is joined with bottom wall 66 of first support portion 63. Outer peripheral surface 69A of second support portion 69 is formed so as to hold operation part 80. Outer peripheral surface 69A of second support portion 69 includes two support surfaces 69B. Support surfaces 69B are surfaces for supporting slide portion 70. One support surface 69B is disposed on outer peripheral surface 69A on one first side wall 64 side. The other support surface (not illustrated) is disposed on outer peripheral surface 69A on the other first side wall 64 side.

Slide portion is mounted on mounting portion 67 in a slidable manner with respect to mounting portion 67 such that a cutting length is changed. The cutting length is a length of hair introduced between fixed blades 22A and movable blades 23A. Slide portion 70 includes a plurality of combs 71, and support plate 75. Combs 71 have a function of guiding hair between fixed blades 22A and movable blades 23A. The plurality of combs 71 are provided on support plate 75 so as to extend from support plate 75, for example.

Support plate 75 is fittable onto support portion 62 so as to cover support portion 62 of holding member 60. Support plate 75 includes a pair of first support plates 75A, second support plate 75B, first insertion portion 75C, and second insertion portion 75E. The pair of first support plates 75A is provided so as to be capable of covering outer surface 64B of first side wall 64. Second support plate 75B is disposed so as to connect one support plate 75A and the other first support plate 75A to each other, and to cover an outer surface (not illustrated) of second side wall 65. The plurality of combs 71 are provided on the pair of first support plates 75A respectively, for example.

First insertion portion 75C is formed in one first support plate 75A, for example, and is disposed fittable on one support surface 69B of second support portion 69. Second insertion portion 75E is formed in the other first support plate 75A, for example, and is disposed fittable on the other support surface of second support portion 69.

By fitting support plate 75 on support portion 62, slide portion 70 is supported by support portion 62.

Operation part 80 has a function of moving slide portion 70 relative to mounting portion 67. Operation part 80 is provided on mounting portion 67 on a side opposite to combs 71, for example. With such a configuration, when hair on a hair-cutting desired portion is cut using electric hair trimmer 10 on which attachment 50 is mounted, operation part 80 is hardly brought into contact with the hair-cutting desired portion. Operation part 80 includes ring 81. Ring 81 is rotatable with respect to mounting portion 67. In one example, ring 81 is mounted on second support portion 69 so as to cover outer peripheral surface 69A in a rotatable manner with respect to second support portion 69. Slide portion 70 is slidable relative to mounting portion 67 by rotating ring 81 and hence, a user can easily adjust a cutting length.

Attachment 50 further includes movement converting part 90. Movement converting part 90 has a function of converting a rotational movement of ring 81 into a translational movement of slide portion 70. Accordingly, the arrangement of ring 81 can be set regardless of a direction of the translational movement of slide portion 70. Movement converting part 90 includes a helical groove (hereinafter referred to as "helical groove 91"), and projection 92. Helical groove 91 is formed on inner peripheral surface 81A of ring 81, for example.

Figure 5:
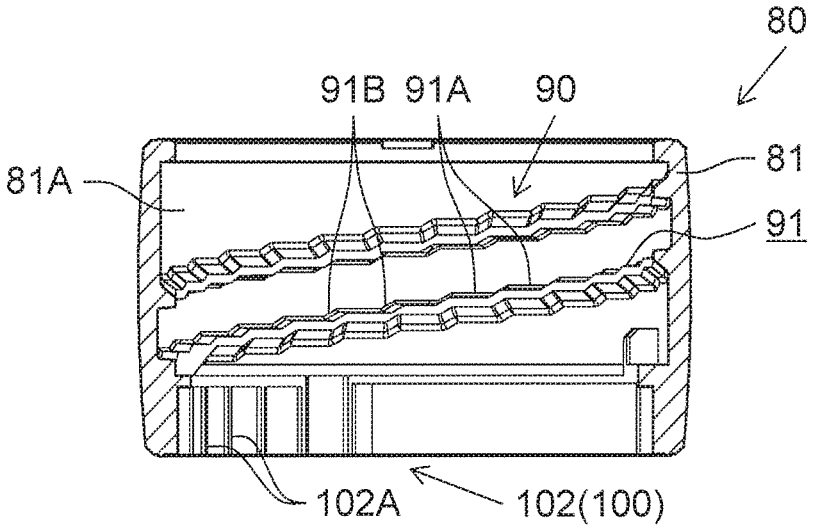
FIG. 5 is a cross-sectional view showing a part of an inner peripheral surface of a ring shown in FIG. 4.

As shown in FIG. 5, helical groove 91 extends helically in a direction orthogonal to a circumferential direction of ring 81 (hereinafter referred to as "orthogonal direction") on inner peripheral surface 81A of ring 81. A movable amount of slide portion 70 (see FIG. 4) with respect to mounting portion 67 is determined based on a length of helical groove 91 in the orthogonal direction of ring 81. Helical groove 91 includes a plurality of steps 91A and a plurality of slopes 91B. Steps 91A constitute portions of helical groove 91 extending along the circumferential direction of ring 81. Slopes 91B constitute portions of helical groove 91 inclined with respect to steps 91A. Helical groove 91 is configured by forming steps 91A and slopes 91B alternately on inner peripheral surface 81A of ring 81.

As shown in FIG. 4, projection 92 is formed on an outer surface of slide portion 70, for example. As one example, projection 92 is formed on outer surface 75D of first insertion portion 75C. Projection 92 is inserted in helical groove 91 so as to be movable in helical groove 91. More specifically, support plate 75 is fitted on support portion 62 such that slide portion 70 is supported by support portion 62, and operation part 80 is mounted on support portion 62 such that projection 92 is inserted in helical groove 91. A rotational movement of ring 81 is converted into a translational movement of slide portion 70 by projection 92 which moves inside helical groove 91 and hence, a moving amount of slide portion 70 relative to a rotation amount of ring 81 becomes small. Accordingly, a user can easily finely adjust a cutting length.

Attachment 50 further includes adjusting mechanism 100. Adjusting mechanism 100 has a function of adjusting a moving amount of slide portion 70 with respect to mounting portion 67. Adjusting mechanism 100 includes first adjusting mechanism 101 and second adjusting mechanism 102. First adjusting mechanism 101 is provided on outer peripheral surface 69A of second support portion 69, for example. Second adjusting mechanism 102 is provided on inner peripheral surface 81A of ring 81, for example.

Figure 6:
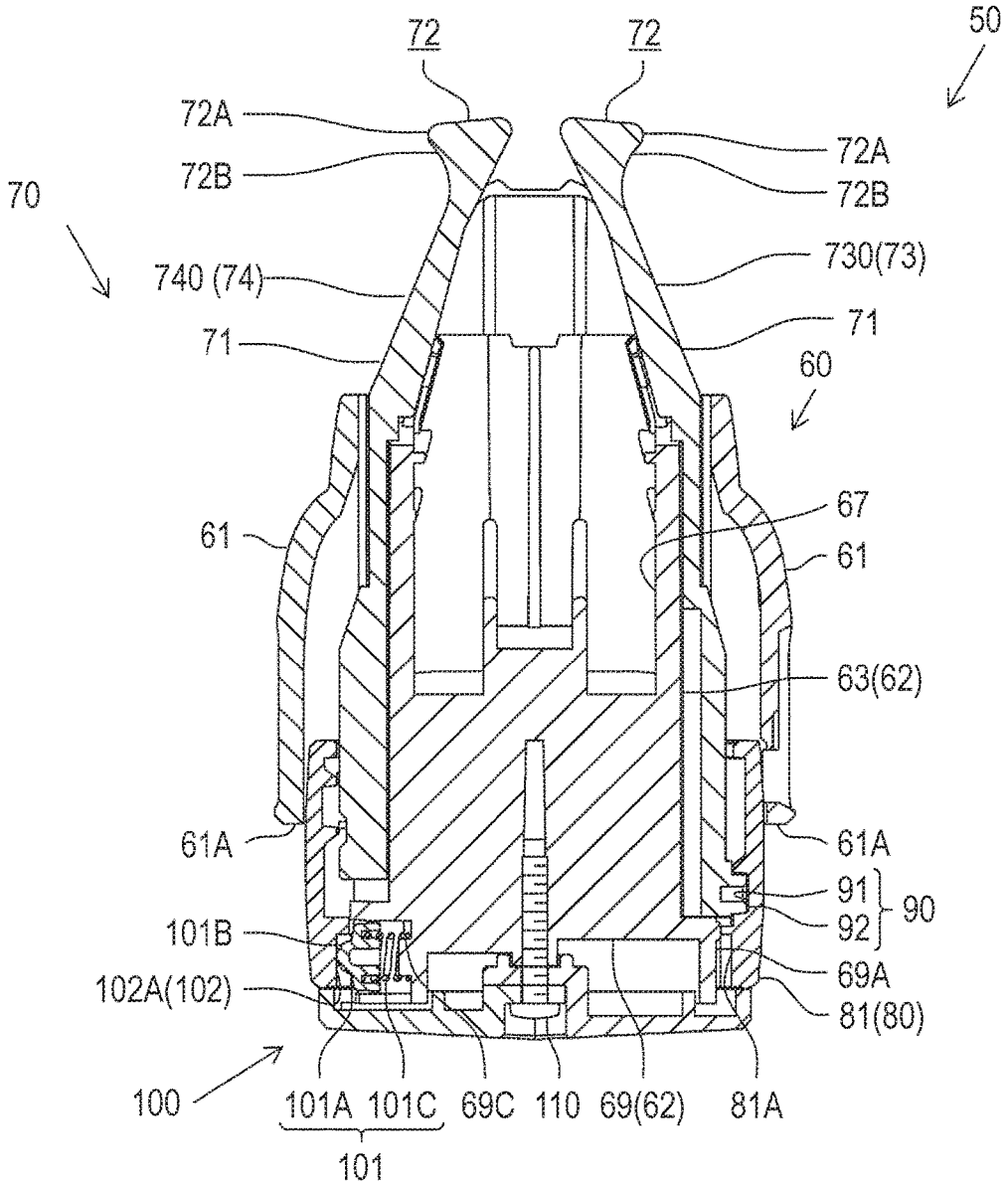
FIG. 6 is a cross-sectional view taken along line D6-D6 in FIG. 1.

As shown in FIG. 6, first adjusting mechanism 101 is mounted in recess 69C formed on outer peripheral surface 69A of second support portion 69. First adjusting mechanism 101 includes click button 101A and elastic member 101C. Click button 101A is mounted in recess 69C by way of elastic member 101C, for example. Click button 101A includes projection 101B. As one example, click button 101A is mounted on elastic member 101C such that projection 101B projects outward. Elastic member 101C has a function of imparting a force to click button 101A such that click button 101A is pushed outward. Elastic member 101C is press-fitted in recess 69C, for example. As one example, elastic member 101C is a coil spring.

Second adjusting mechanism 102 includes a plurality of recesses 102A. The plurality of recesses 102A are arranged continuously on inner peripheral surface 81A of ring 81 in the circumferential direction of ring 81 (see FIG. 4). Click button 101A is fitted in one recess 102A out of the plurality of recesses 102A in a state where operation part 80 is mounted on support portion 62. When ring 81 is rotated by operating operation part 80, recess 102A in which click button 101A is to be fitted is changed. Accordingly, projection 92 of movement converting part 90 moves inside helical groove 91, and slide portion 70 slides with respect to mounting portion 67 in the direction orthogonal to ring 81. In this manner, by changing recess 102A in which click button 101A is to be fitted, a moving amount of slide portion 70 is adjusted in a stepwise manner. Accordingly, a user can further easily adjust a cutting length. Further, each time recess 102A in which click button 101A is to be fitted is changed, click button 101A and recess 102A are brought into contact with each other, and a click sound is generated.

Attachment 50 further includes a screw 110. Screw 110 has a function of fixing respective elements which constitute attachment 50. As one example, support plate 75 of slide portion 70 is fitted on support portion 62, operation part 80 is mounted on support portion 62, and the pair of cases 61 is mounted on support portion 62 so as to cover slide portion 70 and operation part 80. Further, by inserting screw 110 so as to prevent separation of the pair of cases 61 from each other, the respective elements which form attachment 50 are fixed so that attachment 50 shown in FIG. 6 is formed. In a state where attachment 50 is formed, ring 81 of operation part 80 is exposed to the outside through opening 61A formed in the pair of cases 61.

Figure 10:
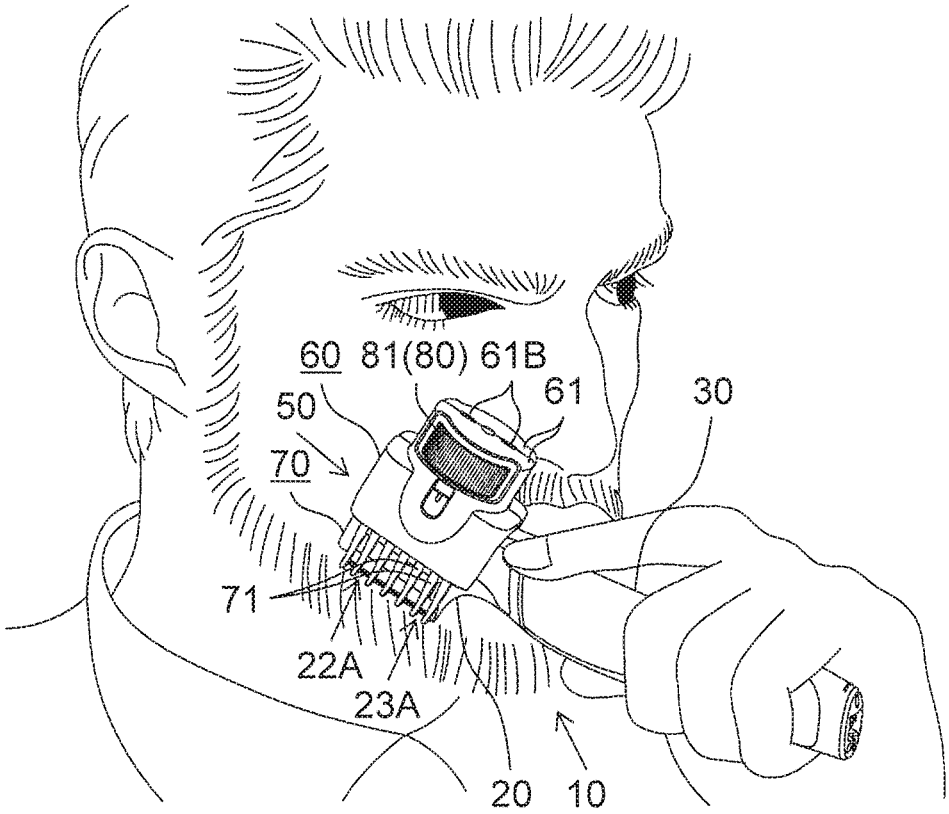
FIG. 10 is a perspective view showing one example of a method of using the electric hair trimmer shown in FIG. 1.

Attachment 50 further includes a pair of discharge ports 61B (see FIG. 10). The pair of discharge ports 61B is formed by joining one case 61 and the other case 61 to each other, and the inside and the outside of attachment 50 are communicated with each other through the pair of discharge ports 61B. When hair cut by electric hair trimmer 10 enters the inside of attachment 50, the hair is discharged to the outside through the discharge ports 61B.

Figure 7:
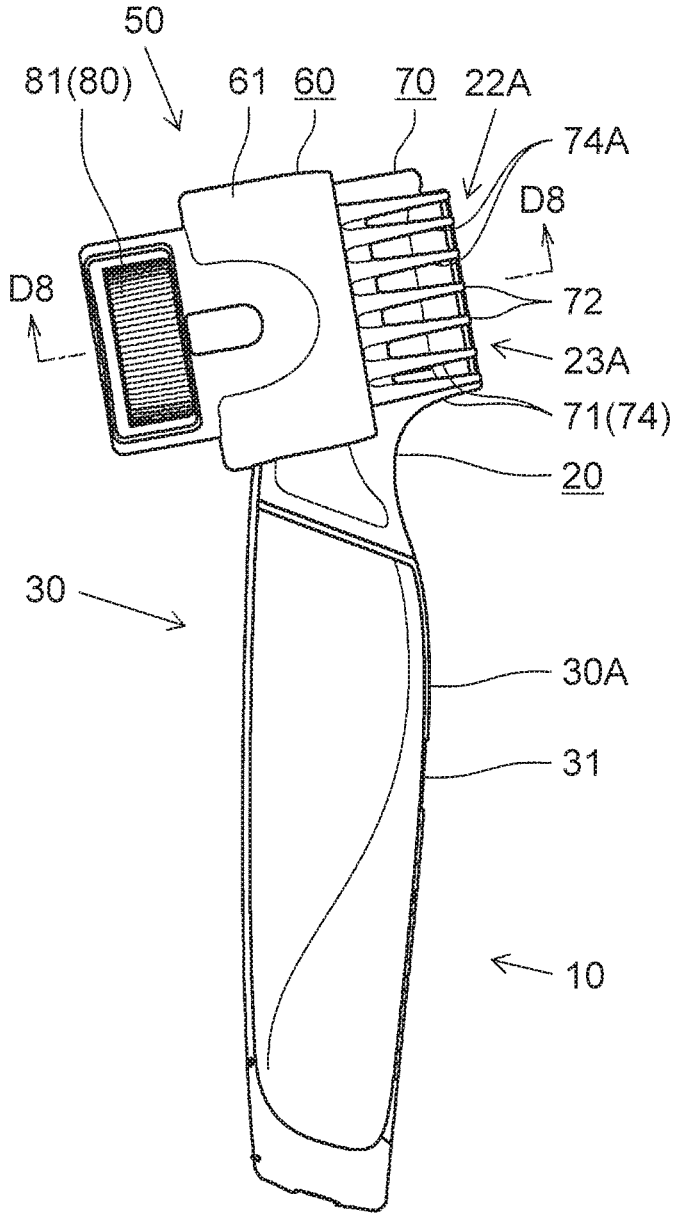
FIG. 7 is a side view showing one example of a first use state of the electric hair trimmer shown in FIG. 1.

FIG. 7 is a view showing electric hair trimmer 10 on which attachment 50 is mounted. Attachment 50 is mounted on electric hair trimmer 10 so as to cover head portion 20. Attachment 50 can take one of a first mode (see FIG. 7) and a second mode (see FIG. 9) which differ from each other in cutting length. The first mode is a mode in which a cutting length becomes longest. The second mode is a mode in which a cutting length becomes shorter than a cutting length in the first mode. As one example, the second mode is a mode in which a cutting length becomes shortest. Attachment 50 can take one of the first mode and the second mode by operating operation part 80.

A size of attachment 50 in a height direction and a size of attachment 50 in a width direction are determined based on a size of head portion 20. The height direction of attachment 50 extends along an extending direction of comb 71 and the direction orthogonal to ring 81. The width direction of attachment 50 extends along the moving direction of movable blades 23A with respect to fixed blades 22A and the width direction of blade unit 21. The size of attachment 50 in the height direction and the size of attachment 50 in the width direction respectively indicate longest sizes in the corresponding directions. As one example, the size of attachment 50 in the height direction of attachment 50 is preferably set to a value which falls within a range of from 5.0 cm to 10.0 cm inclusive. As one example, the size of attachment 50 in the height direction is set to 7.5 cm. The size of attachment 50 in the height direction is the size of attachment 50 in the height direction in the first mode. As one example, the size of attachment 50 in the width direction is preferably set to a value which falls within a range of from 3.0 cm to 7.0 cm inclusive. As one example, the size of attachment 50 in the width direction is set to 5.0 cm.

Figure 8:
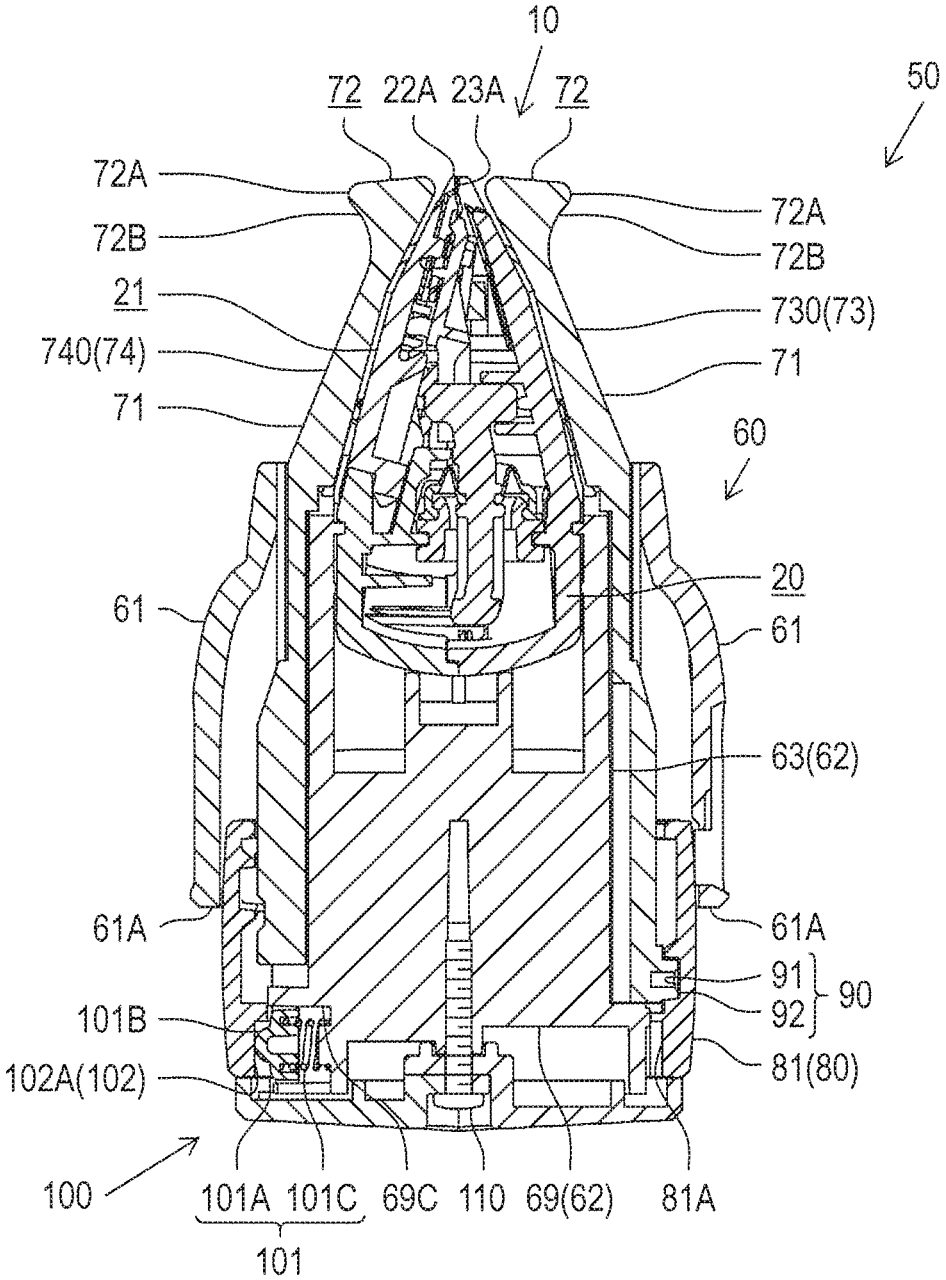
FIG. 8 is a cross-sectional view taken along line D8-D8 in FIG. 7.

FIG. 8 shows a relationship between fixed blades 22A, movable blades 23A, and combs 71 in electric hair trimmer 10 on which attachment 50 is mounted.

The plurality of combs 71 include first comb 73 and second comb 74 (see FIG. 4). First comb 73 includes a plurality of teeth 730. Second comb 74 includes a plurality of teeth 740. First comb 73 is arranged in the longitudinal direction of fixed blades 22A and movable blades 23A, and is disposed on one side portion with respect to fixed blades 22A and movable blades 23A. Tooth 730 included in first comb 73 is inclined in a direction toward fixed blades 22A and movable blades 23A along a shape of blade unit 21, for example. First slit 73A is formed between tooth 730 and tooth 730 included in first comb 73 (see FIG. 4). As one example, the number of teeth 730 included in first comb 73 is seven (see FIG. 4). Second comb 74 is arranged in the longitudinal direction of fixed blades 22A and movable blades 23A, and is disposed on the other side portion with respect to fixed blades 22A and movable blades 23A. Tooth 740 included in second comb 74 is inclined in a direction toward fixed blades 22A and movable blades 23A along the shape of blade unit 21, for example. Second slit 74A is formed between tooth 740 and tooth 740 included in second comb 74 (see FIG. 4). As one example, the number of teeth 740 included in second comb 74 is seven (see FIG. 4).

For example, in a state where attachment 50 is mounted on electric hair trimmer 10, fixed blades 22A and movable blades 23A are disposed between distal end portions 72 of teeth 730 included in first comb 73 and distal end portions 72 of teeth 740 included in second comb 74. Fixed blades 22A and movable blades 23A face the outside from between first slits 73A of comb 73, from between second slits 74A of second comb 74, and from between distal end portions 72 of teeth 730 included in first comb 73 and distal end portions 72 of teeth 740 included in second comb 74. Accordingly, hair is introduced also through between distal end portions 72 of teeth 730 included in first comb 73 and distal end portions 72 of teeth 740 included in second comb 74 toward fixed blades 22A and movable blades 23A. Accordingly, hair on a hair-cutting desired portion can be easily cut by fixed blades 22A and movable blades 23A.

Comb 71 includes hair lifting portion 72A. Hair lifting portion 72A is formed on distal end portion 72 of comb 71 such that hair lifting portion 72A can lift hair on a haircutting desired portion. Hair lifting portion 72A includes inclined surface 72B. Inclined surface 72B is inclined in a direction opposite to fixed blades 22A and movable blades 23A as inclined surface 72B extends from a proximal end side of comb 71 to a distal end side of comb 71. Accordingly, hair is easily lifted by inclined surface 72B of hair lifting portion 72A and hence, hair on a hair-cutting desired portion is unlikely to remain after cutting.

Figure 9:
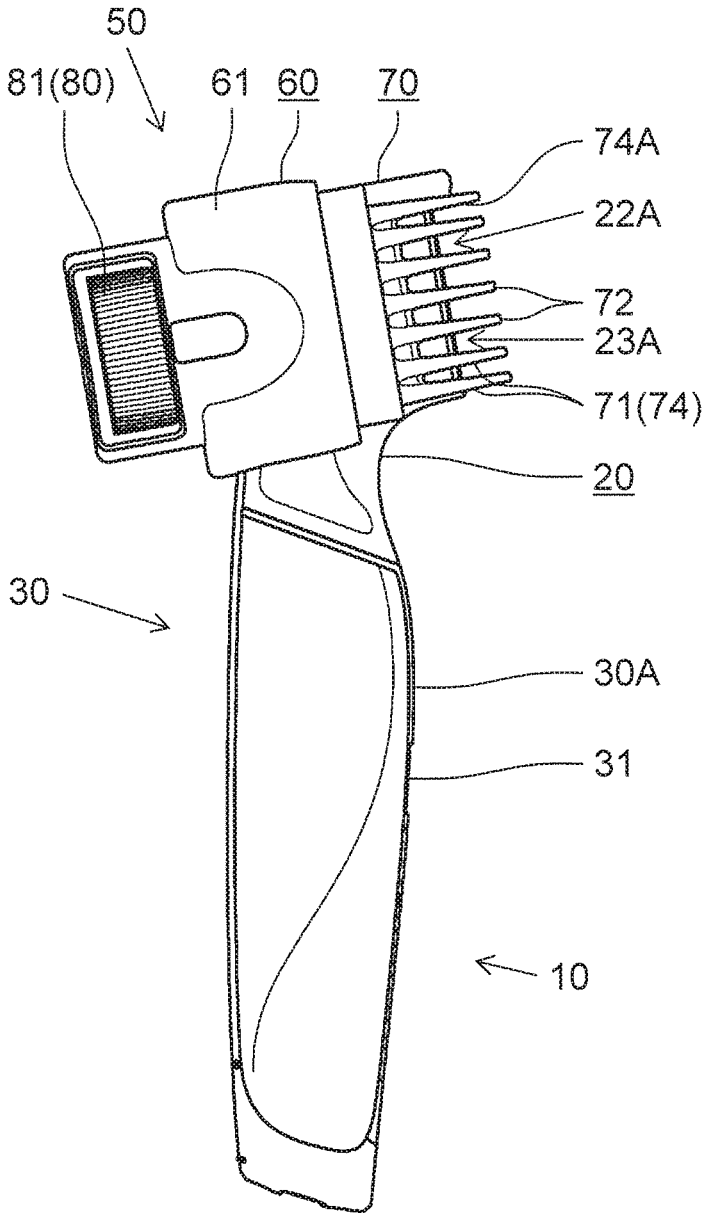
FIG. 9 is a side view showing one example of a second use state of the electric hair trimmer shown in FIG. 1.

With reference to FIG. 7 and FIG. 9, one example of a use state of electric hair trimmer 10 on which attachment 50 is mounted is described.

Electric hair trimmer 10 is used, for example, in a first use mode (see FIG. 7) or in a second use mode (see FIG. 9). The first use mode is a mode in which attachment 50 in the first mode is mounted on electric hair trimmer 10. The second use mode is a mode in which attachment 50 in the second mode is mounted on electric hair trimmer 10. The use mode in which electric hair trimmer 10 is used is arbitrarily selected by a user.

In the first use mode shown in FIG. 7, distal end portions 72 of combs 71 of attachment 50 and cutting edges of fixed blades 22A and cutting edges of movable blades 23A are disposed substantially at the same position in the height direction of attachment 50. When electric hair trimmer 10 is used in the first use mode, hair on a hair-cutting desired portion is cut such that the hair at the hair-cutting desired portion does not substantially remain at the hair-cutting desired portion after cutting.

In the second use mode shown in FIG. 9, distal end portions 72 of combs 71 of attachment 50 and the cutting edges of fixed blades 22A and the cutting edges of movable blades 23A are disposed at a predetermined distance in the height direction of attachment 50. The predetermined distance depends on a moving amount of slide portion 70 in response to an operation of operation part 80.

When electric hair trimmer 10 is used in the second use mode, hair on a hair-cutting desired portion is cut such that hair having a length substantially equal to the predetermined distance remain at the hair-cutting desired portion after cutting. Accordingly, length of hair on the hair-cutting desired portion can be made uniform in a predetermined length.

With reference to FIG. 10, one example of a method using electric hair trimmer 10 and attachment 50 is described.

Electric hair trimmer 10 is used by a user as follows, for example. First, attachment 50 is mounted on head portion 20 of electric hair trimmer 10. Next, operation part 80 of attachment 50 is operated, and a cutting length is adjusted by sliding slide portion 70 with respect to mounting portion 67 (see FIG. 4). Slide portion 70 can be moved with respect to mounting portion 67 in a state where attachment 50 is mounted on head portion 20. Accordingly, a user can easily adjust the cutting length. Accordingly, usability in operation of the electric hair trimmer by a user is enhanced.

Next, by operating power source switch 31 of electric hair trimmer 10 (see FIG. 1), power source of electric hair trimmer 10 is turned on. By turning on power source of electric hair trimmer 10, electric motor 41 (see FIG. 2) is driven, and movable blades 23A move in a reciprocating manner with respect to fixed blades 22A. Then, a user grips grip portion 30 of electric hair trimmer 10 with one hand and slides electric hair trimmer 10 along a skin in a state where combs 71 of attachment 50 are brought into contact with the skin. Accordingly, beard which is one example of hair on a hair-cutting desired portion is cut by fixed blades 22A and movable blades 23A. In an example shown in FIG. 10, electric hair trimmer 10 is used in the first use mode. Electric hair trimmer 10 also can be used without mounting attachment 50 on electric hair trimmer 10.

Modifications

The description relating to the exemplary embodiment is merely one example of the configuration that the attachment of the electric hair trimmer of the present disclosure can take, and does not intend to limit the configuration of the present disclosure. The present disclosure can include, in addition to the exemplary embodiment, following modifications of the exemplary embodiment, and any configurations acquired by combining at least two modifications which do not contradict with each other.

Figure 11:
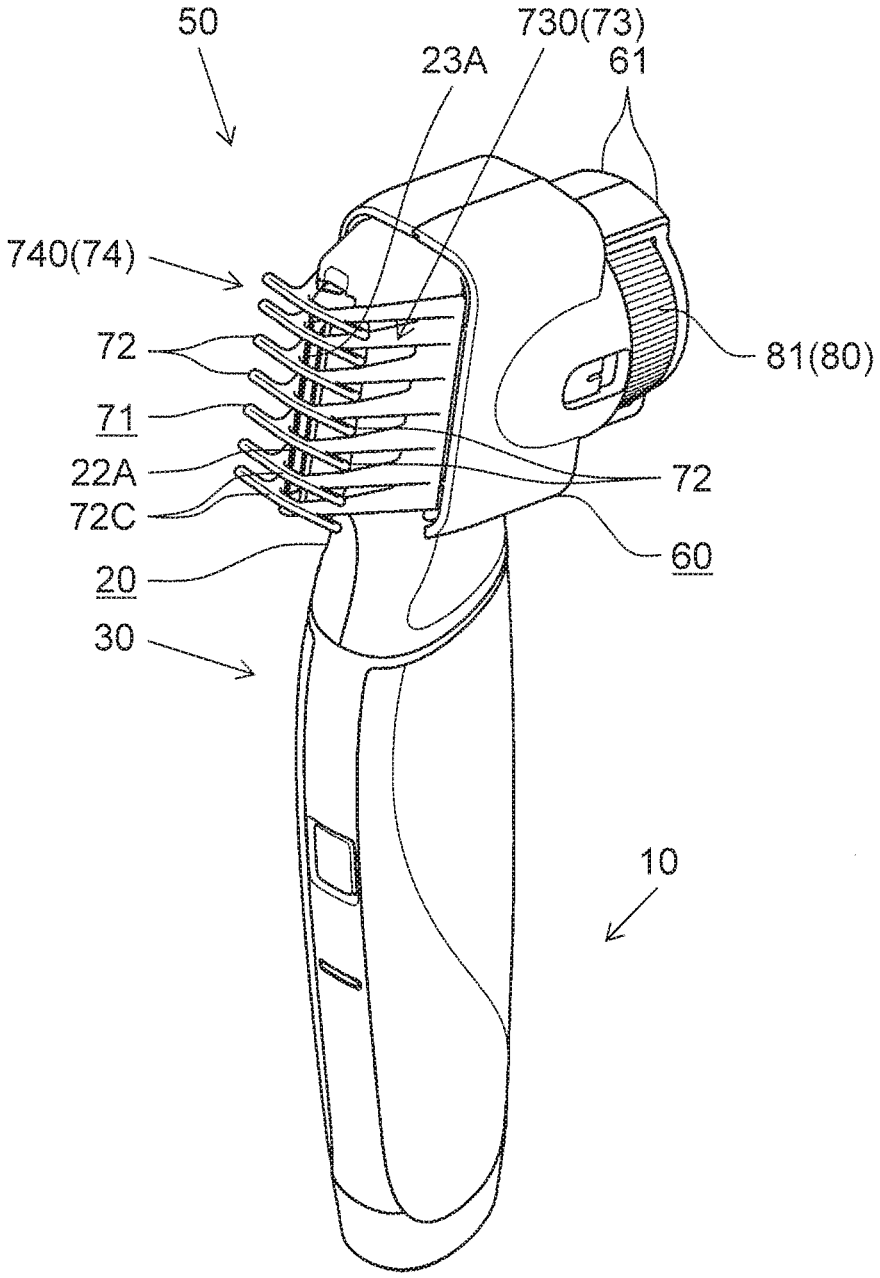
FIG. 11 is a perspective view of an electric hair trimmer on which an attachment according to a modification is mounted.

The configuration of comb 71 of attachment 50 can be changed as desired. In the first modification, as shown in FIG. 11, a plurality of combs 71 further include connecting portions 72C respectively. Connecting portions 72C connect distal end portions 72 of teeth 730 included in first comb 73 and distal end portions 72 of teeth 740 included in second comb 74 to each other so as to cover fixed blades 22A and movable blades 23A. In cutting on a haircutting desired portion by bringing attachment 50 into contact with the hair-cutting desired portion, contact between the hair-cutting desired portion and fixed blades 22A and movable blades 23A is obstructed by connecting portions 72C. Accordingly, fixed blades 22A and movable blades 23A are hardly brought into contact with the hair-cutting desired portion. Further, strength of combs 71 can be enhanced. In the second modification, inclined surface 72B of hair lifting portion 72A is omitted from comb 71. In the third modification, hair lifting portion 72A is omitted from comb 71. In the fourth modification, the number of teeth 730 included in first comb 73 is set to one to six or eight or more. It is preferable that the number of teeth 740 included in second comb 74 be equal to the number of teeth 730 included in first comb 73.

The position of operation part 80 in attachment 50 can be changed as desired. As one example, operation part 80 is provided on an outer surface of one case 61 of attachment 50. According to this modification, opening 68 may be formed on a side opposite to combs 71 with respect to mounting portion 67. More specifically, opening 68 may be formed such that head portion 20 can be inserted in mounting portion 67 by moving support portion 62 relative to fixed blades 22A and movable blades 23A along the height direction of attachment 50.

The relationship between helical groove 91 and projection 92 of movement converting part 90 can be changed as desired. As one example, helical groove 91 is formed on an outer surface of slide portion 70. Projection 92 is formed on inner peripheral surface 81A of ring 81.

Attachment 50 may be configured such that movement converting part 90 is omitted from attachment 50. As a modification, slide portion 70 is mounted on mounting portion 67 in a manually slidable manner with respect to mounting portion 67 such that a cutting length is changed. According to this modification, attachment 50 may be configured such that at least one of operation part 80 and adjusting mechanism 100 is omitted.

The size of attachment 50 can be changed as desired. As a modification, mounting portion 67 of attachment 50 is mountable on head portion 20 of electric hair trimmer 10 having a size suitable for cutting eyebrows and eyelashes.

The attachment of the electric hair trimmer relating to the present disclosure can be used as an attachment for various types of electric hair trimmers such as a household-use electric hair trimmer and a business-use electric hair trimmer.

What is claimed is:

1. An electric hair trimmer, comprising:

a head portion;

a grip portion;

a movable blade on the head portion;

a fixed blade on the head portion; and an attachment mountable on the head portion, wherein:

the electric hair trimmer is configured such that an angle formed by a moving direction of the movable blade with respect to the fixed blade and a longitudinal direction of the grip portion which supports the head portion is an acute angle or the moving direction and the longitudinal direction are parallel to each other, and is configured to adjust a cutting length which is a length of hair introduced between the fixed blade and the movable blade, the attachment comprises:

a mounting portion mountable on the head portion of the electric hair trimmer so as to cover the head portion when the mounting portion is mounted on the head portion;

a slide portion which is mountable on the mounting portion of the attachment in a slidable manner with respect to the mounting portion such that the cutting length is changed when the mounting portion is mounted on the head portion;

a comb formed on the slide portion so as to guide hair between the fixed blade and the movable blade when the mounting portion is mounted on the head portion;

an operation part which is operable for moving the slide portion relative to the mounting portion, wherein the operation part includes a ring rotatable relative to the mounting portion; and a movement converting part configured to convert a rotational movement of the ring into a translational movement of the slide portion, the movement converting part includes a helical groove, and a projection which is inserted in the helical groove such that the projection is movable in the helical groove, one of the helical groove and the projection is formed on an inner peripheral surface of the ring, and the other of the helical groove and the projection is formed on an outer surface of the slide portion.

2. The electric hair trimmer according to claim 1, wherein the operation part is provided such that the mounting portion is located between the operation part and the comb.

3. The electric hair trimmer according to claim 1, further comprising a support portion supporting the slide portion, and the support portion includes:

the mounting portion; and an opening, wherein, when the mounting portion is mounted on the head portion, the head portion is inserted into the mounting portion through the opening.

4. The electric hair trimmer according to claim 1, wherein:

the comb includes a hair lifting portion formed on a distal end portion of the comb such that the comb is capable of lifting hair, and when the mounting portion is mounted on the head portion, the hair lifting portion includes an inclined surface inclined in a direction opposite to the fixed blade and the movable blade as the hair lifting portion extends from a proximal end side of the comb to a distal end side of the comb.

5. The electric hair trimmer according to claim 1, wherein:

the comb includes a plurality of combs, and the plurality of combs include:

a first comb which is arranged in a longitudinal direction of the fixed blade and the movable blade; and a second comb which is arranged in the longitudinal direction of the fixed blade and the movable blade, the first comb and the second comb are arranged such that, when the mounting portion is mounted on the head portion of the electric hair trimmer, the fixed blade and the movable blade are located between the first comb and the second comb, and when the mounting portion is mounted on the head portion, the fixed blade and the movable blade are disposed between distal end portions of a plurality of first teeth included in the first comb and distal end portions of a plurality of second teeth included in the second comb.

6. The electric hair trimmer according to claim 1, wherein:

the comb includes a plurality of combs, and the plurality of combs include:

a first comb which is arranged in a longitudinal direction of the fixed blade and the movable blade;

a second comb which is arranged in the longitudinal direction of the fixed blade and the movable blade; and a connecting portion which connects distal end portions of a plurality of first teeth included in the first comb and distal end portions of a plurality of second teeth included in the second comb, and when the mounting portion is mounted on the head portion of the electric hair trimmer, the connecting portion covers the fixed blade and the movable blade, and the first comb and the second comb are arranged such that, when the mounting portion is mounted on the head portion of the electric hair trimmer, the fixed blade and the movable blade are located between the first comb and the second comb.

7. The electric hair trimmer according to claim 1, wherein the mounting portion is mountable on the head portion of the electric hair trimmer having a size suitable for cutting beard and head hair.

8. An attachment of an electric hair trimmer which is mountable on the electric hair trimmer, wherein the electric hair trimmer is configured such that an angle formed by a moving direction of a movable blade of the electric hair trimmer with respect to a fixed blade of the electric hair trimmer provided on a head portion of the electric hair trimmer and a longitudinal direction of a grip portion of the electric hair trimmer which supports the head portion is an acute angle or the moving direction and the longitudinal direction are parallel to each other, and is configured to adjust a cutting length which is a length of hair introduced between the fixed blade and the movable blade, the attachment comprising:

a mounting portion mountable on the head portion of the electric hair trimmer so as to cover the head portion when the mounting portion is mounted on the head portion;

a slide portion which is mountable on the mounting portion attachment in a slidable manner with respect to the mounting portion such that the cutting length is changed when the mounting portion is mounted on the head portion;

a comb formed on the slide portion so as to guide hair between the fixed blade and the movable blade when the mounting portion is mounted on the head portion;

an operation part which is operable for moving the slide portion relative to the mounting portion, wherein the operation part includes a ring rotatable relative to the mounting portion; and a movement converting part configured to convert a rotational movement of the ring into a translational movement of the slide portion, wherein:

the movement converting part includes a helical groove, and a projection which is inserted in the helical groove such that the projection is movable in the helical groove, one of the helical groove and the projection is formed on an inner peripheral surface of the ring, and the other of the helical groove and the projection is formed on an outer surface of the slide portion.

9. The attachment of an electric hair trimmer according to claim 8, wherein the operation part is provided such that the mounting portion is located between the operation part and the comb.

10. The attachment of an electric hair trimmer according to claim 8, further comprising a support portion supporting the slide portion, and the support portion includes:

the mounting portion; and an opening, wherein, when the mounting portion is mounted on the head portion, the head portion is inserted into the mounting portion through the opening.

11. The attachment of an electric hair trimmer according to claim 8, wherein the comb includes a hair lifting portion formed on a distal end portion of the comb such that the comb is capable of lifting hair, and when the mounting portion is mounted on the head portion, the hair lifting portion includes an inclined surface inclined in a direction opposite to the fixed blade and the movable blade as the hair lifting portion extends from a proximal end side of the comb to a distal end side of the comb.

12. The attachment of an electric hair trimmer according to claim 8, wherein:

the comb includes a plurality of combs, and the plurality of combs include:

a first comb which is arranged in a first direction; and a second comb which is arranged in the first direction, the first comb and the second comb are arranged such that a center line of the attachment is located between the first comb and the second comb, and when the mounting portion is mounted on the head portion, the fixed blade and the movable blade are capable of being disposed between distal end portions of a plurality of first teeth included in the first comb and distal end portions of a plurality of second teeth included in the second comb.

13. The attachment of an electric hair trimmer according to claim 8, wherein:

the comb includes a plurality of combs, and the plurality of combs include:

a first comb which is arranged in a first direction;

a second comb which is arranged in the first direction; and a connecting portion which connects distal end portions of a plurality of first teeth included in the first comb and distal end portions of a plurality of second teeth included in the second comb, and the first comb and the second comb are arranged such that a center line of the attachment is located between the first comb and the second comb.

14. The attachment of an electric hair trimmer according to claim 8, wherein the mounting portion is mountable on the head portion of the electric hair trimmer having a size suitable for cutting beard and head hair.

15. An attachment of an electric hair trimmer, the attachment comprising:

a mounting portion;

a slide portion;

a comb formed on the slide portion so as to guide hair;

an operation part which is operable for moving the slide portion relative to the mounting portion, wherein the operation part includes a ring rotatable relative to the mounting portion; and a movement converting part configured to convert a rotational movement of the ring into a translational movement of the slide portion, wherein:

the movement converting part includes a helical groove, and a projection which is inserted in the helical groove such that the projection is movable in the helical groove, one of the helical groove and the projection is formed on an inner peripheral surface of the ring, and the other of the helical groove and the projection is formed on an outer surface of the slide portion.

16. The attachment according to claim 15, wherein the operation part is provided such that the mounting portion is located between the operation part and the comb.

17. The attachment according to claim 15, further comprising a support portion supporting the slide portion and including the mounting portion and an opening.

18. The attachment according to claim 15, wherein:

the comb includes a hair lifting portion formed on a distal end portion of the comb such that the comb is capable of lifting hair, and the hair lifting portion includes an inclined surface in a first direction as the hair lifting portion extends from a proximal end side of the comb to a distal end side of the comb.

19. The attachment according to claim 15, wherein:

the comb includes a plurality of combs, and the plurality of combs include:

a first comb which is arranged in a first direction; and a second comb which is arranged in the first direction, the first comb and the second comb are arranged such that a center line of the attachment is located between the first comb and the second comb, and the center line is disposed between distal end portions of a plurality of first teeth included in the first comb and distal end portions of a plurality of second teeth included in the second comb.

20. The attachment according to claim 15, wherein:

the comb includes a plurality of combs, and the plurality of combs include:

a first comb which is arranged in a first direction;

a second comb which is arranged in the first direction; and a connecting portion which connects distal end portions of a plurality of first teeth included in the first comb and distal end portions of a plurality of second teeth included in the second comb, and the first comb and the second comb are arranged such that a center line of the attachment is located between the first comb and the second comb.

* * * * *